US009211477B1

(12) United States Patent
Fisher

(10) Patent No.: US 9,211,477 B1
(45) Date of Patent: Dec. 15, 2015

(54) FOLDING TRAPDOOR DROP MECHANISM

(71) Applicant: Skyturtle Technologies Ltd., Enderby (CA)

(72) Inventor: Lance C. Fisher, Enderby (CA)

(73) Assignee: Skyturtle Technologies Ltd. (CA)

( * ) Notice: Subject to any disclaimer, the term of this patent is extended or adjusted under 35 U.S.C. 154(b) by 0 days.

(21) Appl. No.: 14/579,097

(22) Filed: Dec. 22, 2014

Related U.S. Application Data

(60) Provisional application No. 61/919,734, filed on Dec. 21, 2013.

(51) Int. Cl.
*A63G 21/18* (2006.01)
*A63B 9/00* (2006.01)

(52) U.S. Cl.
CPC ..... *A63G 21/18* (2013.01)

(58) Field of Classification Search
CPC ..... A63G 21/00; A63G 21/02; A63G 21/18; A63G 31/007; A63B 9/00; A63B 2009/006
USPC ..... 472/13, 116, 117, 128; 104/69, 70
See application file for complete search history.

(56) References Cited

U.S. PATENT DOCUMENTS

| | | | | |
|---|---|---|---|---|
| 3,210,077 | A * | 10/1965 | Hjelte | 472/116 |
| 4,379,551 | A * | 4/1983 | Ahrens | 472/116 |
| 5,183,437 | A | 2/1993 | Millay et al. | |
| 6,280,342 | B1 | 8/2001 | Tod | |
| 2014/0194216 | A1 | 7/2014 | Brassard et al. | |
| 2014/0329610 | A1* | 11/2014 | Theilgaard | 472/117 |
| 2015/0045129 | A1* | 2/2015 | Brassard | 472/117 |

* cited by examiner

*Primary Examiner* — Kien Nguyen
(74) *Attorney, Agent, or Firm* — Dwayne E. Rogge; Schacht Law Office, Inc.

(57) ABSTRACT

A trapdoor mechanism and method of providing a trapdoor mechanism for initiating descent into a slide ride is disclosed. Aspects of invention are directed to an trapdoor mechanism utilizes a folding and unfolding support structure so that the folding of the trap door provides a platform to stand on and the unfolding provides an opening into a slide. Embodiments of the trapdoor drop amusement mechanism utilize a downward and unfolding motion instead of rotary swing motion to remove the trap door from the ride path. A control device may be utilized to apply force to the trapdoor during its transit between the open position and closed position. This apparatus allows for less deck foot print area as no trap door swing thru or large shock absorber that is normally required to dissipate the large amount of energy stored in a heavy rotating trap.

6 Claims, 5 Drawing Sheets

FOLDING TRAPDOOR DROP MECHANISM

RELATED APPLICATIONS

This application claims priority benefit of U.S. Ser. No. 61/919,734, filed Dec. 21, 2013, incorporated herein by reference.

BACKGROUND OF THE DISCLOSURE

Field of the Disclosure

This application relates to the field of actuated entrances to water slide amusement rides.

BRIEF SUMMARY OF THE DISCLOSURE

Disclosed herein is a folding trapdoor for an amusement ride comprising: a slide tube section; a standing platform formed of at least one platform panel upon which a participant stands; the platform panel having a laterally outer edge pivotally attached to the tube section; the platform panel having an inner edge; a substantially planar support panel having an upper edge pivotally attached to the inner edge of the platform panel; the support panel having a lower edge linearly and vertically repositioned; and the platform panel and the support panel forming surfaces of a chute through which a participant passes to a slide.

The folding trapdoor as recited above may further comprise a sliding panel having an upper edge pivotally attached to the lower edge of the support panel.

The folding trapdoor as recited above may be arranged wherein the sliding panel forms a wall of the chute.

The folding trapdoor as recited above may further comprise: a guide wheel attached at each longitudinal edge of the upper edge of the sliding panel; a guide wheel attached at each longitudinal edge of a lower edge of the sliding panel; and a guide track attached to the slide tube section so as to limit the sliding panel to substantially vertical movement.

The folding trapdoor as recited above may be arranged wherein: the slide tube section comprises an upper tube section having substantially planar sides; a taper section at a lower edge of the upper tube section; the taper section having substantially planar sides at an upper edge, and substantially cylindrical sides at a lower edge; and a substantially cylindrical slide attached to the lower edge of the taper section.

The folding trapdoor as recited above may be arranged wherein the amusement ride is a waterslide having a volume of water flowing there though.

DETAILED DESCRIPTION OF THE DISCLOSURE

Figure 1:
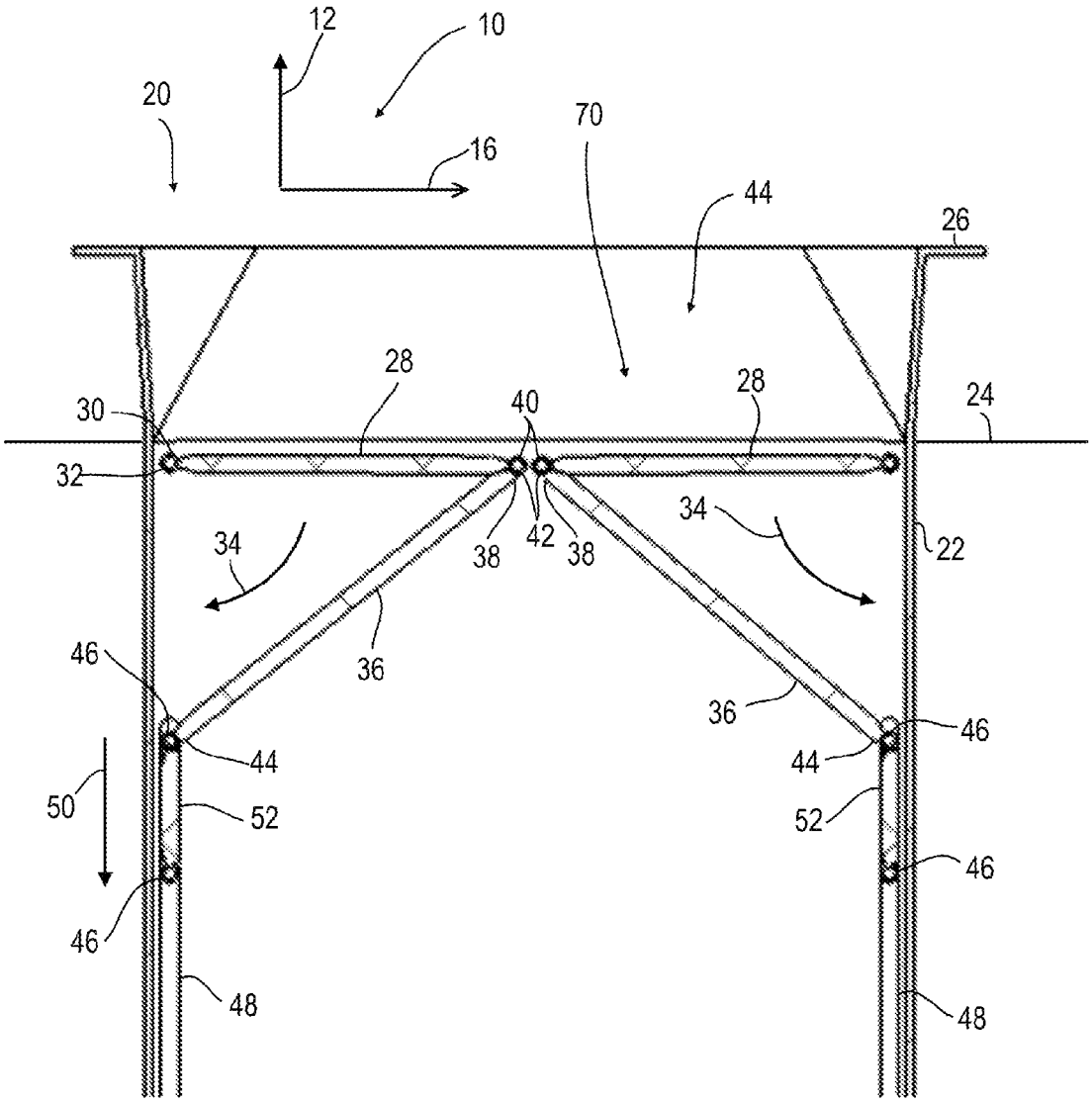
FIG. 1 is a side cutaway view of the trapdoor apparatus in a fully closed position.

Many water slide rides attract participants by offering high speed travel through the slide. To achieve such high speeds, such water slides may include a trapdoor system that quickly drops a participant from a rest (standing) position to a vertical or near vertical descent into the slide ride via a chute. The water slide amusement ride generally has a volume of water flowing there though to reduce friction between the participant and the inner surfaces of the slide. Such trapdoor systems are traditionally actuated by a series of springs or pistons that forcefully and quickly move the trapdoor between a closed position and an open position. Such devices require large amounts of energy to operate. In addition, such devices may be dangerous if a participant becomes stuck by the trapdoor and pinned by the force of a spring or piston.

A novel folding trapdoor mechanism and method of providing a folding trapdoor mechanism for initiating a participant's descent into a slide ride is disclosed. The disclosed folding trapdoor utilizes a folding and unfolding panel support structure. In this way, closing of the trapdoor provides a platform to stand upon, and the unfolding (opening) provides an opening into a slide. The term standing will be used to indicate the pose of the participant on the closed folding trapdoor for ease in description although it is to be understood that the participant may otherwise be posed on the folding trapdoor platform prior to descent. Examples of the folding trapdoor mechanism utilize a downward and unfolding motion instead of the traditional rotary swing motion to remove the door from the ride path. A control device may be utilized to apply force to the trapdoor during its transit between the open position and closed position. Such a control device may be an elastic member, solenoid, hydraulic cylinder, pneumatic cylinder or equivalent. Generally, an operator will control actuation of the folding trapdoor via a control system connected to the release actuators. Once the ride is sufficiently or completely clear of a previous participant, the operator will position a second participant on the ride and release the folding trapdoor, dropping the participant into the chute.

This folding trapdoor allows for less footprint area on the deck as no trap door swing thru or large shock absorber is required to dissipate the large amount of energy stored in such prior art heavy rotating trapdoors.

Examples of the folding trapdoor drop mechanism provide an energy efficient method to quickly drop a participant into a slide, or waterslide ride. Embodiments of the folding trapdoor drop amusement mechanism utilize a folding and unfolding support structure so that the folding of the trapdoor provides a platform for the participant to stand on, and the unfolding trapdoor provides an opening (chute) into a slide. In one particular example, the slide is a water slide having a volume of water transiting with the participant. Embodiments of the trapdoor drop amusement mechanism utilize a downward and laterally outward unfolding motion instead of relatively simplistic rotary swing motion to remove the trap door from the ride path.

Disclosed is a folding panel apparatus for initiating descent into a slide ride, having in one example: a slide segment for receiving a participant; and a folding platform assembly folding between an open and a closed position. The closed position being configured such that the participant may be positioned (standing, lying, kneeling, or sitting for example) upon the standing platform. The platform in the open position being configured such that the participant descends into the (water) slide upon actuation of the trapdoor release mechanism after having been positioned upon the platform when the platform is in the closed position. The platform in one example is configured to be conveyed to the closed position from the open position at least in part by an unfolding of panel segments. In one example the angle between the standing platform and the support panel is less in the closed position than in the open position.

The apparatus may be arranged wherein the standing platform is formed of two (or more) platform panels pivoting vertically downward and in opposite horizontal directions to allow the participant to descend through the chute into the slide. The upper surfaces of the platform panels form inner surfaces of the chute when opened.

The apparatus may be arranged wherein the standing platform(s) in the closed position are substantially perpendicular to the standing platform(s) in the open position.

The apparatus may be arranged wherein the standing platform(s) in the open position two is at an angle greater than 90 degrees to the closed position.

Looking to FIG. 1 is shown a folding trapdoor dropped mechanism 20 cut through a vertical plane so as to show the internal mechanism. The laterally outer surfaces shown in FIG. 1 comprise an upper tube section 22 extending downward from a deck level 24.

Projecting above the deck 24 in some examples is a railing 26 or flange which protects nonparticipants from accidentally straying onto the platform panel(s) 28. The railing 26 may also assist the participant in properly positioning themselves upon the platform panels 28 prior to actuating the drop mechanism. In this example it can be seen that each platform panel 28 has at its laterally outward edge 30 a pivot 32 attached to the upper tube section 22. This allows for the platform panels 28 to pivot in direction 34 when released.

Before continuing, and axes system 10 is disclosed having a vertical axis 12, a longitudinal axis 14 lying in a horizontal plane and a lateral axis 16 also lying in a horizontal plane and being orthogonal to each of the vertical axis 12 and the longitudinal axis 14. These axes are intended to aid in description of the overall apparatus and are not in and of themselves intended to limit the apparatus to a specific orientation. For example, the axes may be offset somewhat to account for a non-vertical drop of the participant.

Continuing with a description of the apparatus shown in FIG. 1, a support panel 36 can be seen having an upper edge 38 attached to a horizontally inward edge 40 at a pivot 42. The support panel 36 in this closed position 44 extends angularly from the upper and 38 to a lower end 44. The lower edge 44 is shown attached to at least one guide wheel 46 which rides in a vertical track 48. The track 48 comprised in one example of a section of I-channel, C-channel, plurality of rails, rabbet, groove, or similar structure allowing the lower edge 44 to traverse vertically downward 50 in the track 48 without any substantial lateral movement at the lower edge 44.

In one example, the lower edge 44 of each support panel 36 is pivotally attached to a sliding panel 52. Each sliding panel 52 having a plurality of guide wheels 46 on each longitudinal end which travel upward and downward 50 in the tracks 48. These sliding panels 52 at rigidity and support to the overall structure and also form part of the chute formed as the folding trapdoor mechanism 20 repositions from the closed position 44 shown in FIG. 1 to the open position 54 shown in FIG. 2.

Figure 2:
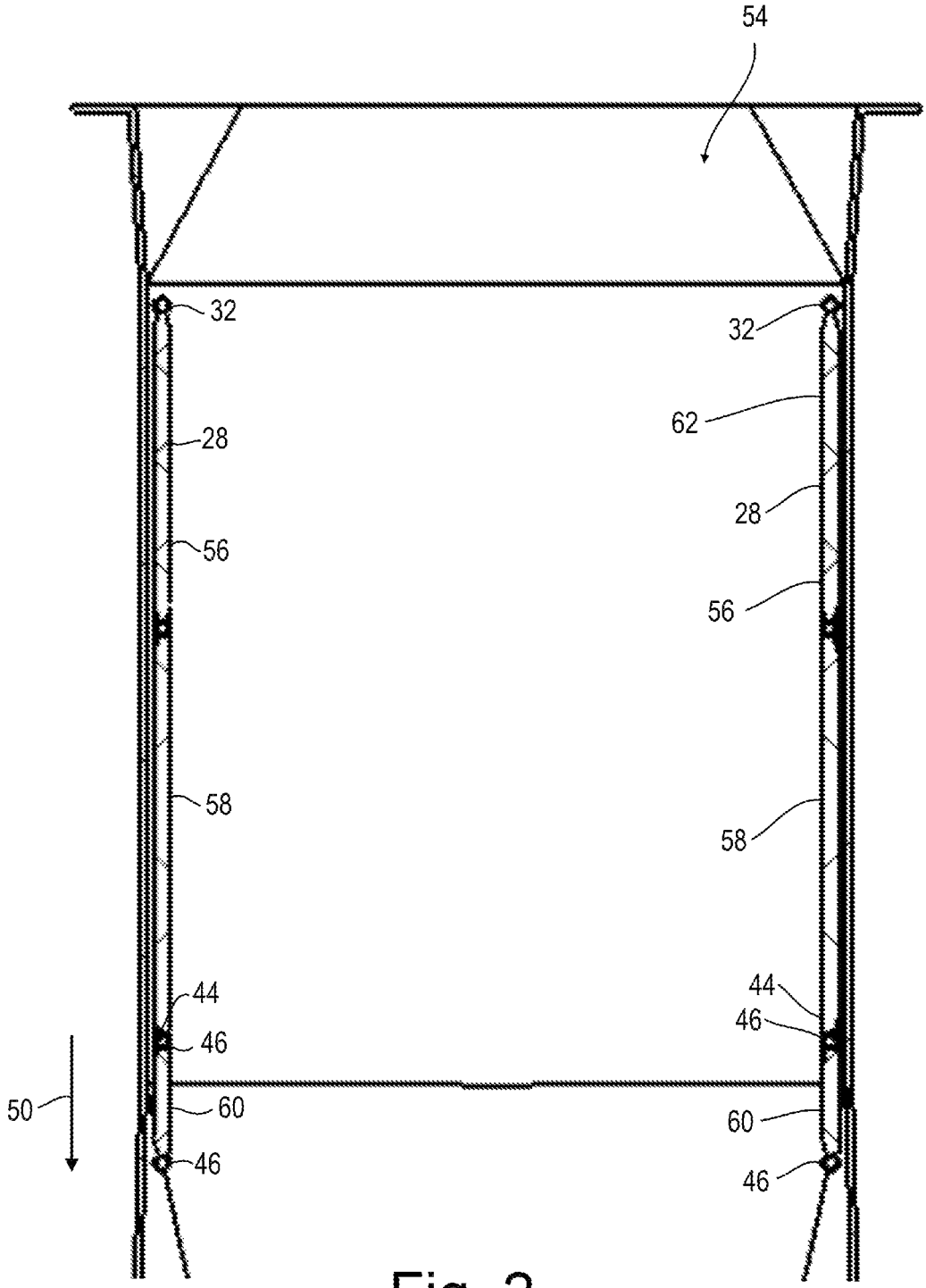
FIG. 2 is a side cutaway view of the trapdoor apparatus in a fully open position.
Figure 4:
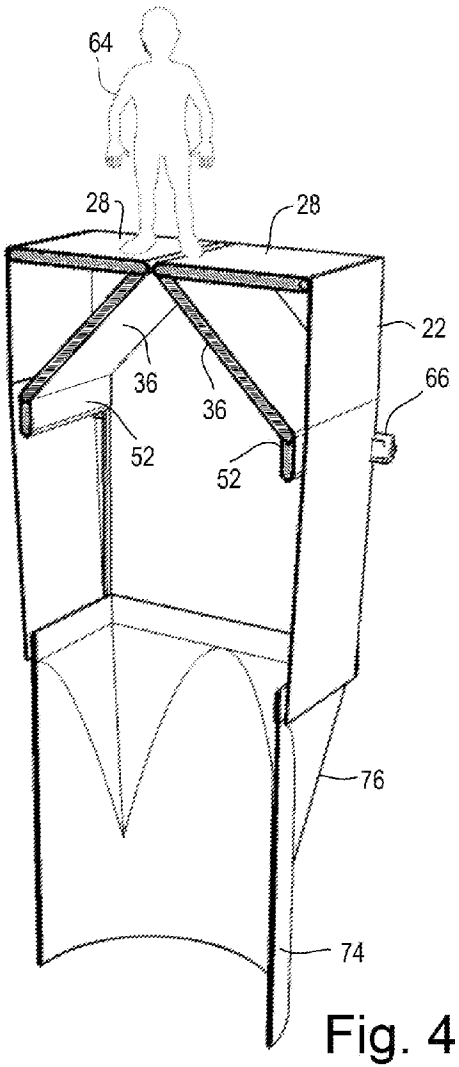
FIG. 4 is a perspective cutaway view of the trapdoor apparatus in a fully closed position.

Moving to FIG. 2, it can be seen that the platform panels 28 have pivoted about pivots 32 in direction of travel 34 (FIG. 1) and the support panels 36 have pivoted and repositioned downward 50 in a complex movement such that the lower edge 44 and guide wheels 46 of the support panels 36 have moved in a downward direction 50. In this way, the inner surfaces 56, 58, and 60 of the platform panels 28, support panel 36 and optional sliding panels 52 respectively form a chute 62 through which the participant 64 will travel.

Figure 3:
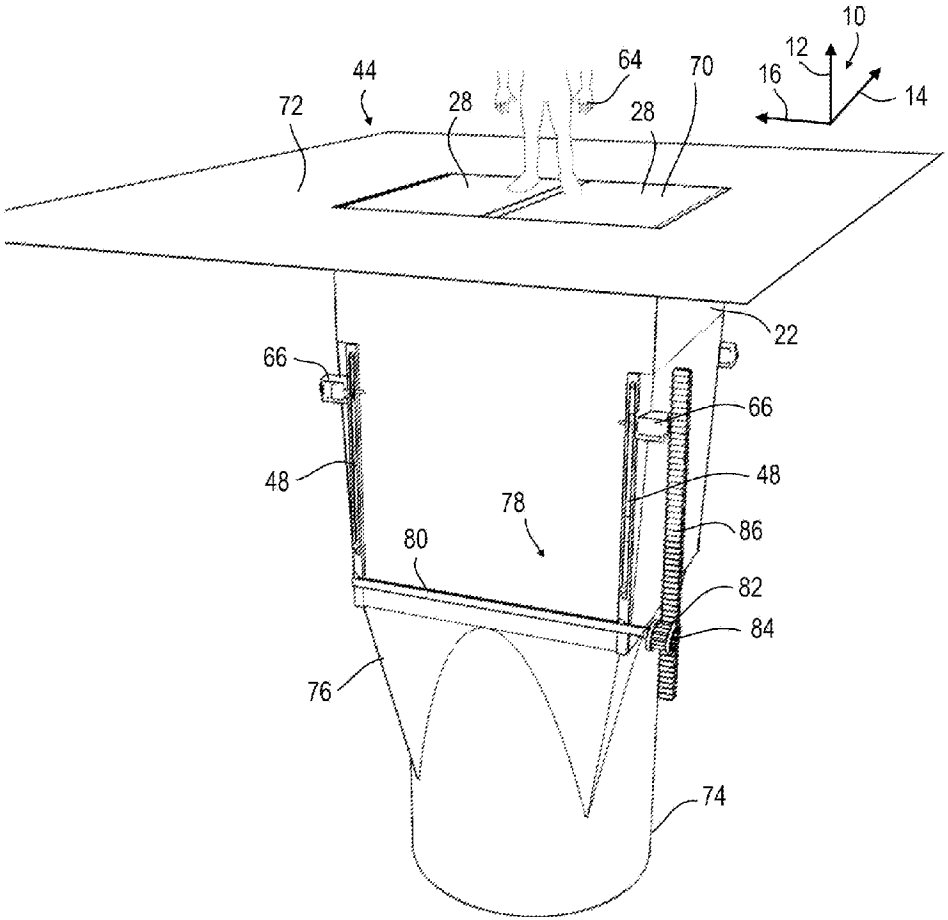
FIG. 3 is a perspective exterior view of the trapdoor apparatus in a fully closed position.

Looking to FIG. 3 it can be seen how the participant 64 is standing upon the platform panels 28 and is prepared to be dropped into the chute 62. Moving briefly on to FIG. 8, it can be seen how a lift pin 58 extends through channels in the tracks 48 in this example. The lift pin 94 of this example extends from the guide wheel 46 at the lower edge 44 of the support panel 36 or from the sliding panel 52. The lift pin 94 may extend from the upper guide wheel 46. The lift pin may alternatively extend inward from the lift bar 80 or equivalent. Once raised to the closed position 44 shown in FIG. 3, a solenoid 66, pneumatic actuator, hydraulic actuator, or equivalent device having an extending or rotating catch pin 68 is actuated to hold the standing platform 70 in place while a participant is loaded. The catch pin 68 engaging the lift pin 94 or another component of the sliding panel 52 or support panel 36 so as to maintain the apparatus in the closed position 44. Upon subsequent actuation of the solenoid 66 to withdraw the catch pin 68 it can be understood that the folding trapdoor mechanism 20 will drop and the participant will enter the chute 62. As can be appreciated in FIG. 3, multiple solenoids 66 may be utilized at different positions about the apparatus.

In FIG. 3 it can be seen how the participant 64 is standing upon the standing platform 70 comprised of platform panels 28. As can be seen, the standing platform 70 is substantially planar with a surrounding deck 72 although the deck 72 may be above or below the plane of the standing platform 70. The upper tube section 22 can be seen as can be seen the lower slide section 74 with a taper (transition) section 76 there between. The taper section 76 in this example provided as the upper tube section 22 has substantially planar sections and the lower slide section 74 is arcuate and in this example is substantially cylindrical. Thus, the taper section 76 provides a smooth transition there between. Clearly, it will be desired not to have any sharp or protruding edges as the participant 74 transiting from the chute 62 to the lower slide section 74 may otherwise be injured.

Clearly, if the upper section is the same (planar or curvilinear) as the slide, the taper section is not required.

Although a laterally opposed pair of mechanisms is shown, it can also be appreciated that 3, 4, 5, or more mechanisms may be utilized to reduce the rotational inertia of each standing platform.

Figure 7:
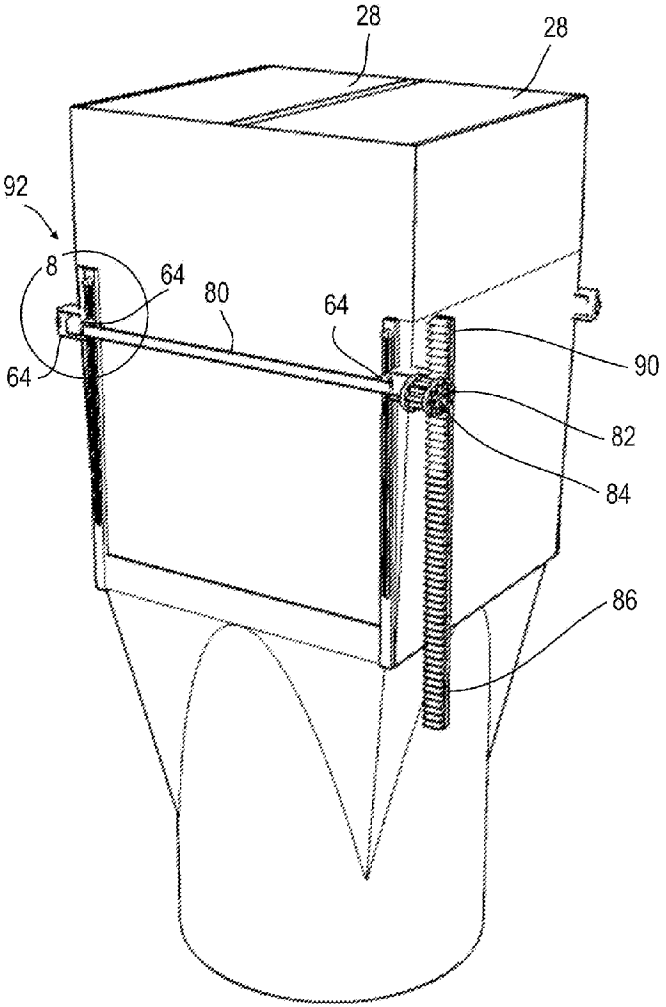
FIG. 7 is a perspective view of the trapdoor apparatus in a reset position.

In FIG. 3, one example of a lift system 78 can be seen comprising a lift bar 80 attached to a (pinion) gear 82 driven by a motor 84. The gear 82 engaging a gear rack 86 so as to enable lifting of the lift bar 80 from the lower position shown in FIG. 3 to the reset position shown in FIG. 7.

Figure 8:
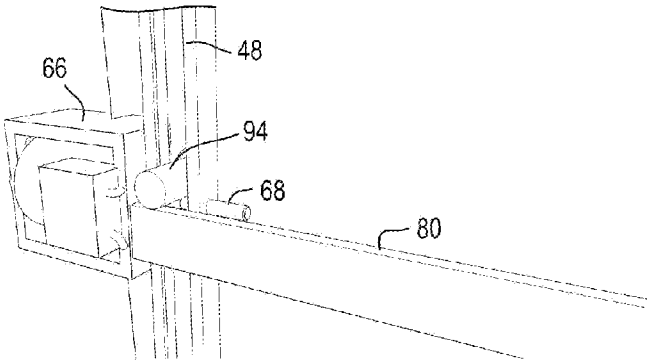
FIG. 8 is a detail view of a section 8 of FIG. 7.
Figure 9:
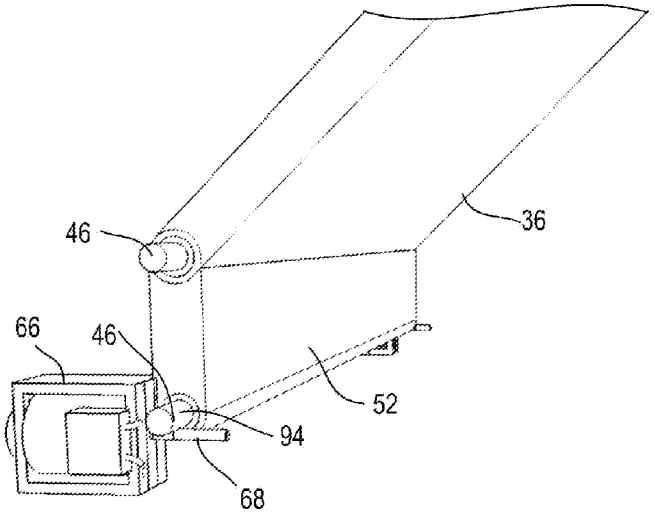
FIG. 9 is a view of FIG. 8 with exterior surfaces removed to show the internal components.

Looking to FIG. 8, it can be seen how the lift pin 94 in this example extends outward of the track 48 so as to be engaged by the lift bar 80. Thus, as the motor 84 drives the gear 82 and lift bar 80 upwards 12 to the position shown in FIG. 7, the lift pin 94 will be raised and thus raise the lower edge 44 of the support panel 36. As previously mentioned, in this example, once the lifting apparatus is in the uppermost, closed position 44 the catch pin 68 will support the lower edge 44 of the support panel 36. The gear 82 will be at the upper end 90 of the gear rack 86. In this example, the catch pin 68 engages the lift pin 94. This reset position is clearly shown in FIG. 7. In this reset position 92, the lift bar 80 may be in the way of the lift pin(s) 94 upon release of the catch pin 68. Thus, as can be seen in FIG. 3, the lift system 78 is repositioned to the lower end 88 of the gear rack 86 prior to release of the catch pin(s) 68.

In one example where the solenoids 66 are mounted to the lift bar 80 or equivalent, the lift pins 94 may be the same as the catch pins 68.

As is obvious to one of ordinary skill in the art, the lift bar 80 can alternatively be attached to the gear rack 86 and the motor 84 and gear 82 fixed relative to the upper tube section 22. Also, lift system 78 may utilize a screw drive, pneumatic cylinders, hydraulic cylinders, solenoid, or equivalent in place of the rack and pinion system.

Figure 5:
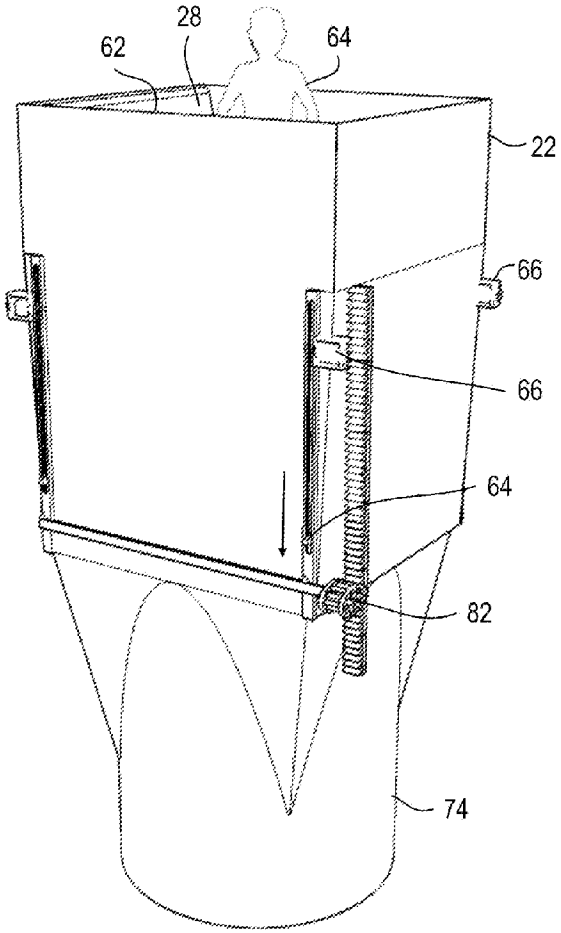
FIG. 5 is a perspective exterior view of the trapdoor apparatus in a fully open position.

Looking to FIG. 5 it can be seen that the solenoids 66 have released and the lift pins 64 have repositioned downward to the lower end of the tracks 48. The participant 64 has thus dropped into the chute 62. The chute 62 is more easily seen in FIG. 6.

As it can be understood that the lower edge 44 of the support panels 36 moves vertically upward, if the apparatus is opened to the fully vertical position shown in FIG. 2, the pivot 42 may be aligned with pivots 32 and guide wheels 46. This may cause binding of the apparatus when it is repositioned to the closed position or to a past top dead center position. Thus it may be desired for the pivots 32 to be positioned laterally outward from a line of transit of the lower edge 44. This positioning may well cause the surface 62 of the platform panels 28 to be angularly disposed laterally inward from the pivots 32. This may additionally help the participant 64 be positioned in the lateral center of the chute 62.

Figure 6:
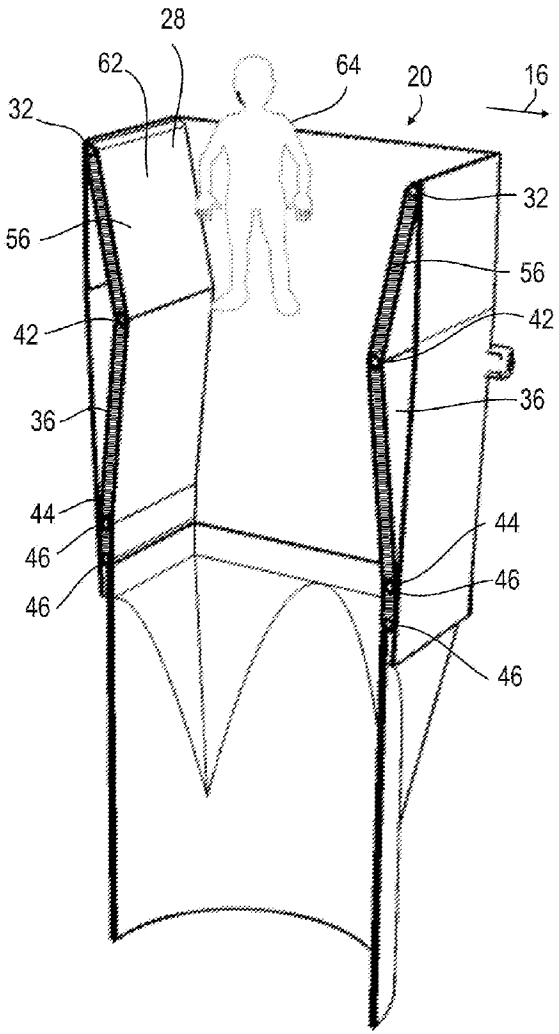
FIG. 6 is a perspective cutaway view of the trapdoor apparatus in a fully open position.

In another example, shown in FIG. 6, the pivots 42 are repositioned laterally inward from the pivots 32. In addition, the pivots 42 are positioned laterally inward from the lower edges 44. Each of these orientations and relative positions Keith's the folding trapdoor mechanism 20 from binding as the lift mechanism repositions following transit of a participant 64.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A folding trapdoor for an amusement ride comprising:
- a slide tube section;
- a standing platform formed of at least one platform panel upon which a participant stands;
- the platform panel having a laterally outer edge pivotally attached to the tube section;
- the platform panel having a laterally inner edge;
- a substantially planar support panel having an upper edge pivotally attached to the inner edge of the platform panel;
- the support panel having a lower edge linearly and vertically repositioned; and
- the platform panel and the support panel forming surfaces of a chute through which a participant passes to a slide.

2. The folding trapdoor as recited in claim 1 further comprising:
- a sliding panel having an upper edge pivotally attached to the lower edge of the support panel.

3. The folding trapdoor as recited in claim 2 wherein the sliding panel forms a wall of the chute.

4. The folding trapdoor as recited in claim 2 further comprising:
- a guide wheel attached at each longitudinal edge of the upper edge of the sliding panel;
- a guide wheel attached at each longitudinal edge of a lower edge of the sliding panel; and
- a guide track attached to the slide tube section so as to limit the sliding panel to substantially vertical movement.

5. The folding trapdoor as recited in claim 1 wherein:
- the slide tube section comprises an upper tube section having substantially planar sides;
- a taper section at a lower edge of the upper tube section;
- the taper section having substantially planar sides at an upper edge, and substantially cylindrical sides at a lower edge; and
- a substantially cylindrical slide attached to the lower edge of the taper section.

6. The folding trapdoor as recited in claim 1 wherein the amusement ride is a waterslide having a volume of water flowing there though.

* * * * *